United States Patent [19]

Ohta

[11] Patent Number: 4,511,615

[45] Date of Patent: Apr. 16, 1985

[54] METHOD FOR MANUFACTURING AN ADHESIVE INTERLINING AND FABRIC PRODUCED THEREBY

[75] Inventor: Nobuo Ohta, Showa, Japan

[73] Assignee: Firma Carl Freudenberg, Weinheim, Fed. Rep. of Germany

[21] Appl. No.: 454,638

[22] Filed: Dec. 30, 1982

[30] Foreign Application Priority Data

Feb. 3, 1982 [JP] Japan ..... 57-16741

[51] Int. Cl.[3] ..... B32B 3/00

[52] U.S. Cl. ..... 428/198; 156/280; 156/291; 156/296; 156/308.2; 428/195; 428/284; 428/286; 428/287; 428/296; 428/298; 428/302; 428/303; 428/343; 428/354; 428/355; 428/373; 428/374

[58] Field of Search ..... 428/284, 286, 287, 296, 428/298, 302, 303, 373, 374, 195, 198, 224, 343, 354, 355; 156/280, 296, 308.2, 291

[56] References Cited

U.S. PATENT DOCUMENTS 4,373,000 2/1983 Knoke et al. ..... 428/195

*Primary Examiner*—James J. Bell

*Attorney, Agent, or Firm*—Kenyon & Kenyon

[57] ABSTRACT

A method of making a two layer non-woven fabric is described wherein the first layer of thermoplastic bicomponent fibers is autogeneously heat bonded to the second layer of thermoplastic fibers without compression and the surface of the first layer is coated with a heat-melting adhesive. The softening temperature of the second layer thermoplastic fibers is at least 20° C. higher than the softening temperature of the adhesive. The components of the bicomponent fibers are low and high softening temperature components. The softening temperature of the low temperature component is higher than that of the second layer fibers.

9 Claims, 1 Drawing Figure

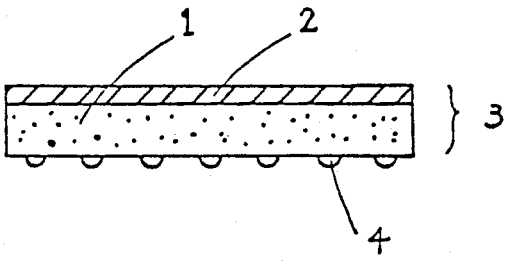
1
2
3
4

METHOD FOR MANUFACTURING AN ADHESIVE INTERLINING AND FABRIC PRODUCED THEREBY

BACKGROUND OF THE INVENTION

This invention relates to a method of manufacturing an adhesive interlining which has greatly improved characteristics. It is much more resistant to the countersoiling and wear caused by repeated washing and dry cleaning.

Non-woven fabrics of the state of the art are composed of fibers collected in the form of a web and bonded to each other with compound thermoplastic adhesive fibers. Adhesive interlinings made of non-woven fabric in this way and having a coating of heat melting adhesive at one surface thereof are known to have a pleasant feel. The non-woven fabrics of these adhesive interlinings are composed of webbed fibers alone, and are therefore characterized by being free of counter soiling caused by washing or dry cleaning. These fabrics, however, become extremely fuzzy when subjected to repeated washing or dry cleaning and are subject to pilling or formation of an unpleasant hairy texture. It is evident that known adhesive interlinings for washable fabrics in the apparel industry have some undesirable characteristics.

Accordingly, it is an object of the invention to produce an interlining fabric which does not become fuzzy or pile up when washed. Another object is to produce an interlining fabric which is soft and has a pleasant feel but nevertheless resists wear caused by cleaning.

SUMMARY OF THE INVENTION

These and other objects are achieved by the present invention which is directed to a method for manufacturing a soft, wear resistant fabric and to the fabric produced by this method. The method produces an adhesive interlining composed of a non-woven fabric having one surface which is coated with heat melting adhesive having a softening temperature range which can be achieved by hot ironing processes.

The method provides a first web layer containing about 10 to 40% by weight of thermoplastic bicomponent fiber mass, the bicomponent fibers comprising a low softening temperature range component and a high softening temperature range component, providing a second surface web layer overlaid on the first web layer, weighing about 5 to 40 g/m$^2$, and containing 10 to 50% by weight of thermoplastic fibers whose softening temperature range is lower than that of the low temperature component fibers but at least 20° C. higher than that of the heat melting adhesive. The two layers are bonded into one sheet of non woven fabric without pressing by use of heat treatment at a temperature enough for softening and bonding the low temperature component fibers. The heat melting adhesive is then coated on the side of the first web layer of said non-woven fabric.

In a preferred method of manufacturing the adhesive interlining the weight ratio between the first web layer and the second surface web layer is within a range from 4:1 to 1:1.

The invention is also directed to the interlining produced by this process. It is a two layer non-woven fabric having the component fibers as described above which are autogeneously bonded together without compression. The fabric has an adhesive coating on one side.

BRIEF DESCRIPTION OF THE DRAWING

FIG. 1 shows a cross section view of the fabric according to the invention.

DETAILED DESCRIPTION OF THE INVENTION

Reference to the drawing showing a cross-sectioned view of the adhesive interlining according to the invention, will illustrate the method of manufacturing the adhesive interlining composed of a non-woven fabric having one surface coated with heat melting adhesive. In this method, a first web layer 1 is provided which weighs 5 to 40 g/m$^2$, and contains 10 to 50% by weight of thermoplastic fibers having a softening temperature range lower than that of the low temperature component fibers but at least 20° C. higher than that of the heat melting adhesive. The two layers are bonded into one sheet of non-woven fabric 3 without pressing by use of heat treatment at a temperature sufficient to soften the low temperature component fibers and the second web fibers and for bonding thereof; and to provide heat-melting adhesive 4 on the side of the first web layer 1 of the non-woven fabric.

An adhesive interlining manufacture by a method according to this invention has a desirable feel and exhibits highly improved resistance toward the effects of repeated washing and dry cleaning.

The first web layer 1 according to this invention contains 10 to 40% by weight of thermoplastic bicomponent fiber mass constituting low melting-point component and high melting point component fibers for bonding of all fibers to each other. This thermoplastic bicomponent fiber may be of core-sheath type or joint type. Typically, a core-sheath type polyamide thermoplastic bicomponent fiber can be used wherein the temperature differential between the low and high softening temperature components is about 40°–50° C. For example, a bicomponent fiber can be used in which the low softening point component is nylon-6 in the form of sheath having the softening point of about 215° C. and the other high softening point component is nylon-66 in the form of a core having a softening-point of about 255° C. Thermoplastic bicomponent fibers of olefin or polyester may also be used.

Synthetic fibers including polyamide, polyester, and acrylic, regenerated fibers such as rayon, and natural fibers such as cotton, hereafter called "non-thermoplastic fibers", can be used as the fibers making up the remaining weight percentage in both the first and second webs. Additionally, high softening temperature thermoplastic fibers can be used to make up the remainder of the fibers in the first and second webs.

Since non-woven fabrics produced by heat treatment of a web containing thermoplastic fibers mixed with non-thermoplastic fibers have until now been used as a foundation for interlining, bonding has been applied only to intersections of individual fibers. However, this has resulted in an interlining surface which has lacked strength. The second surface web layer 2 according to this invention alleviates this difficulty. It contains 10 to 50% by weight of thermoplastic fibers whose melting point is lower than that of the low temperature component fibers but at least 20° C. higher than that of the heat-melting adhesive. If this thermoplastic fiber has a softening temperature range lower or less than 20° C.

higher than that of the heat-melting adhesive, an undesirable film is formed on the surface of the interlining due to hot pressing required to bond the interlining to the surface cloth. Thermoplastic fiber synthetics such as polyamide, polyester, and polyolefin have been used in this regard. For example, nylon 6 fibers having a softening point of 215° C. as described above and other low softening polyester or polyolefin fibers have been widely used.

The second surface web layer 2 is composed of a mixture of thermoplastic fibers with non-thermoplastic fibers so as to weigh 5 to 40 g/m$^2$ and to be overlaid on one side of the web layer 1. The arrangement of fibers in the web layer 2 may be uni-directional or non-directional, but uni-directional fibers are less subject to pilling.

In the present invention, the weight ratio between the web layer 1 and the surface web layer 2 is ideally set within the range 1:1 to 4:1. That is to say, it is desirable to raise or lower the weight ratio of the web layer 1 to the other layer 2 to make the fabric more or less bulky. When the surface web layer 2 is larger than the web layer 1 in weight ratio, not only bulk but also feel of the fabric to the touch are unfavorably affected.

Thermoplastic fibers contained in the surface web layer 2 may be mixed with the web layer 1 but ideally should be few, so as to produce easily a non-woven fabric which is fluffy, resilient and has the optimum bulk.

By laying one web layer on the other and applying heat treatment thereto without pressing and using a temperature sufficient for softening and bonding together the low-softening temperature component fibers, individual fibers in the web as well as the first web layer and the second surface web layer are bonded into one sheet. In this case, if pressing is done, the thermoplastic fibers are crushed and enlarged at the contact areas thereof, so that the feel of the non-woven fabric is much less pleasant to the touch. This occurs because the compression prevents production of bonded fibers having multiple bonding points along their lengths in the form of small particle-shaped beads in the web layer.

According to the present invention, since heat treatment is not followed by pressing, the thermoplastic fibers are shrunk and formed into small particle like forms so as to tightly bond the fibers with each other at points on the surface thereof. Consequently, the pleasant feel of the product is not affected even though strong adhesion between fibers is obtained and, further, surface strength of the fiber is markedly increased.

Finally, the adhesive interlining is finished through the process known as spreading, printing, or spraying heat-melting adhesive 4 on the web layer 1 of the non-woven fabric 3.

The heat-melting adhesive 4 used in this process may be polyamide, polyester, and polyvinyl chloride resins in the state of powder, emulsion, paste, or solution.

An adhesive interlining according to the present invention bonded to the surface cloth does not cause pilling, unpleasant fuzzy, shedding fibers and is highly resistent to the effects of repeated washing and dry cleaning.

An adhesive interlining exemplifying this invention and another comparative example are provided as a further illustration of the invention.

EXAMPLE 1

Two Layer Fabric

A non-woven fabric was made up in the following manner:

A web layer in weight of 35 g/m$^2$ was produced by carding a mixture of 20% by weight of core-sheath type thermoplastic bicomponent polyamide fiber (3d×51 mm) mass constituting low softening temperature component (nylon-6, melting point: 215° C.) and high softening temperature component fibers (nylon-66, melting point: 255° C.) with 80% by weight of nylon-66 fibers (3d×51 mm).

A surface web layer in weight of 25 g/m$^2$ was produced by carding a mixture of 20% by weight of nylon-6 (1.5d×51 mm) with 80% of nylon-66 (3d×51 mm).

The layers were overlayed and treated with a hot air dryer at a temperature of 240° C. Then heat-melting polyamide adhesive was applied to the side of the web layer in a dot-like arrangement so as to be 18 g/m$^2$ in dry weight. The adhesive interlining made up in this way was evaluated as Class 4 in resistance to washing and dry cleaning and caused neither pilling nor an unpleasant fuzzy feel.

COMPARATIVE EXAMPLE

Single Layer Fabric

The make-up process of a non-woven fabric utilized a web in weight of 60 g/m$^2$ produced by carding a mixture of 20% by weight of core-sheath type thermoplastic bicomponent polyamide fiber (3d×51 mm) mass constituting low softening temperature component (nylon-6, melting point: 215° C.) and high softening temperature component fibers (nylon-66, melting point: 255° C.) with 80% by weight of nylon 66 (3d×51 mm). The web was treated with a hot air drier at the temperature of 240° C.; and heat melting polyamide adhesive was applied to one side of the non woven fabric so as to be 18 g/m$^2$ in dry weight in a dot-like arrangement. This interlining was evaluated as only Class 1 in resistance to washing and Class 3 to dry cleaning.

As described above, the method according to the present invention allows the manufacture of adhesive interlinings which are superior not only in that they feel pleasant to the touch, but also in their resistance to washing and dry cleaning.

What is claimed is:

1. A method for manufacturing a soft non-woven fabric having a coating on one side of a heat-melting adhesive having a hot iron softening temperature range, which comprises:

forming a first web layer of about 10 to about 40% by weight of a thermoplastic bicomponent fiber mass, the bicomponent fibers comprising a first low softening temperature range component and a second high softening temperature range component;

forming a second web layer of about 10 to about 50% by weight single component thermoplastic fibers having a softening temperature range equal to or lower than the softening temperature range of said first low softening temperature range component of said bicomponent fibers but at least 20° C. higher than the softening temperature of the heat-melting adhesive;

overlaying the second web on top of the first web;

bonding the first and second webs without compressing them, by heating the webs to a maximum temperature which causes softening of the low softening temperature range component of the bicomponent fibers and the fibers of the second web to produce a bonded fabric having a first web side and a second web side; and coating the first web side of the bonded fabric with the heat-melting adhesive, to produce the non-woven fabric having an adhesive coating on one side.

2. A method according to claim 1 comprising applying the heat-melting adhesive to the bonded fabric, as a tacky, flowable material and at a temperature from ambient to a temperature rendering the adhesive tacky.

3. A method according to claim 1 comprising forming the first web of core sheath or joint bicomponent fibers wherein the temperature differential between the low and high softening temperature range components is about 40°-50° C.

4. A method according to claim 3 wherein the bicomponent fibers are core-sheath type with the low temperature component being nylon-6 having a softening temperature range of about 215° C. and the high temperature component being nylon-66 having a softening temperature range of about 255° C.

5. A method according to claim 1 wherein the weight ratio of the first web to the second web is from about 1:1 to about 4:1.

6. A method according to claim 1 wherein the low softening temperature range component is nylon-6, the high softening temperature range component is nylon-66, the bicomponent fibers are core-sheath type, the fibers of the second web are nylon-6, the layers are bonded at a temperature of about 240° C. and the heat-melting adhesive is polyamide applied in a dot-like arrangement.

7. A method according to claim 1 wherein the remaining weight percentages of fibers in the first and second webs comprise high softening temperature thermoplastic fibers or non-thermoplastic fibers.

8. A soft, non-woven autogeneously bonded fabric with a thermoplastic adhesive coating on one side, comprising two overlapping layers of thermoplastic fibers autogeneously bonded together without compressing, with a thermoplastic adhesive coated on the outside surface of the first layer, the adhesive having a hot iron thermoplastic softening temperature range, the fibers of the first layer comprising about 10 to about 40% by weight bicomponent fibers having a low softening temperature range component and a high softening temperature range component, and the fibers of the second layer comprising about 10% to about 50% by weight unitary fibers having a softening temperature range equal to or lower than that of the low softening temperature range component but at least 20° C. higher than the softening temperature of the adhesive coating.

9. A fabric according to claim 8 wherein the remaining weight percentages of fibers in the first and second layers comprise high temperature softening thermoplastic fibers or non-thermoplastic fibers.

* * * * *